US005374873A

United States Patent [19]

Tsuneoka et al.

[11] Patent Number: 5,374,873

[45] Date of Patent: Dec. 20, 1994

[54] GYROTRON APPARATUS HAVING VIBRATION ABSORBING MEANS

[75] Inventors: Masaki Tsuneoka, Urizura; Keishi Sakamoto; Takashi Nagashima, both of Katsuta; Tsuyoshi Kariya; Yukio Okazaki, both of Tokyo, all of Japan

[73] Assignee: Kabushiki Kaisha Toshiba, Kawasaki, Japan

[21] Appl. No.: 897,781

[22] Filed: Jun. 12, 1992

[30] Foreign Application Priority Data

Jun. 14, 1991 [JP] Japan ..... 3-143375
Feb. 25, 1992 [JP] Japan ..... 4-38001

[51] Int. Cl.[5] ..... H01J 23/34; H01J 25/00

[52] U.S. Cl. ..... 315/5; 315/5.38; 331/79

[58] Field of Search ..... 315/4, 5, 5.38; 331/79

[56] References Cited

U.S. PATENT DOCUMENTS 2,971,115 2/1961 Nelson ..... 315/5
3,259,790 7/1966 Goldfinger ..... 315/5.38 X
3,336,491 8/1967 Mercer et al. ..... 315/5.38 X
4,200,820 4/1980 Symons ..... 315/4

FOREIGN PATENT DOCUMENTS 57-069646 4/1982 Japan .
187736 7/1989 Japan ..... 315/5
47645 2/1992 Japan ..... 315/5
2136197 9/1984 United Kingdom ..... 315/5

OTHER PUBLICATIONS

Matthews et al., "The Gyrotron-A Key Component of High-Power Microwave Transmitters", Brown Boveri Review, No. 6, 1987, pp. 303-307.

*Primary Examiner*—Benny T. Lee
*Attorney, Agent, or Firm*—Cushman, Darby & Cushman

[57] ABSTRACT

In a gyrotron apparatus, an oscillator tube unit and a collector are coupled by a bellows. The collector is received in an evaporation boiler jacket. The oscillator tube is supported on a stand and the collector and the boiler jacket is supported on the other stand.

7 Claims, 6 Drawing Sheets

GYROTRON APPARATUS HAVING VIBRATION ABSORBING MEANS

BACKGROUND OF THE INVENTION

1. Field of the Invention

The present invention relates to a gyrotron apparatus and more particularly, a gyrotron apparatus having an improved arrangement with an oscillator tube unit and a collector structure can be fixed to individual supports.

2. Description of the Related Art

As is well-known, the gyrotron apparatus is an electron tube whose operation is based on the electron cyclotron maser. This gyrotron apparatus has become increasingly common as a source for generating high-frequency waves of high power ranging from millimeter to sub-millimeter waves.

The gyrotron apparatus of this type includes an oscillation tube unit, a means for cooling a collector structure, and a superconductive magnet to form electron beam gyromotion. The oscillator tube unit includes: an electron gun section for generating electron beam; an electro-magnetic interaction section having a resonant cavity therein in which a high frequency electro-magnetic field is generated, a gyrating electron beam being introduced into the high frequency electric field to cause the fields to interact with one another; a collector for collecting the electron beam thus subjected to such interaction; and an electro-magnetic wave output section serving to pick up the electro-magnetic waves which have been generated in the interacting space outside the apparatus and having a dielectric window for air-tightly sealing the tube to maintain a vacuum in the tube. This gyrotron apparatus wherein the electron beam which has been subjected to the interaction is injected and collected by the collector and wherein a mode converter is housed to direct the high frequency waves traverse in front of the collector and pick up them through the output section projected from the side of the oscillator tube unit, is particularly suitable for high average power.

The collector of the high average power gyrotron is sometimes cooled by evaporation cooling. The cooling system of this type has a boiler jacket enclosing the collector electrodes. A vapor duct or coolant guide member is connected to the boiler jacket to exhaust vapor to outside of the gyrotron. The gyrotron apparatus has a length of several meters and a weight of several tons. In such a large gyrotron apparatus, the collector vibrates during operation. Particularly in a case where evaporation cooling is used, vibration is caused by bubbles generated when cooling water is boiled. As a result, the collector and the boiler jacket of the cooling system can severely vibrate. When this vibration is transmitted to the electro-magnetic interaction section and the electron gun section of the oscillator tube unit, and also to the super conductive magnet thereof, they are also vibrated. This vibration disturbs the positional relation between the electron beam, the high frequency electric field, and the magnetic field of the electromagnet at the interaction section defined in the resonant cavity, thereby degrading the normal oscillation of the gyrotron. Further, this vibration can cause breakage or damage to the super conductive magnet or other fragile component in the oscillator tube.

SUMMARY OF THE INVENTION

The object of the present invention is therefore to provide a gyrotron apparatus capable of maintaining stable oscillating operation by preventing vibration from being transmitted to any sensitive components and also by protecting any of these sensitive components from damage even if the collector structure is vibrated or shaken when the gyrotron apparatus is in operation.

According to the present invention, a gyrotron apparatus is provided comprising a gyrotron oscillation tube unit, including means for generating a gyrating electron beam, interaction means having a resonant cavity in which a high frequency electromagnetic field is generated which interacts with the gyrating electron beam to generate electromagnetic waves, collecting means for collecting the electron spent beam after the interaction, means for cooling the collecting means, first support means for positionally fixing and holding said generating means and interaction means, second support means arranged independently of the first support means to support the collecting and the cooling means, and deformable coupling means arranged with an air-tight seal between the electromagnetic interaction means of the oscillator tube unit and the collecting means to isolate the vibrations of the collector means.

According to the present invention, a gyrotron apparatus is provided wherein a first selectively attached vacuum bellows is arranged between the interaction section of the oscillator tube unit and the collector and wherein a second selectively attached bellows is arranged between the boiler jacket and the vapor duct.

According to the gyrotron apparatus of the present invention, the vibration of the collector caused when cooling water is boiled, for example, can be absorbed by the bellows to prevent it from propagating into the resonant cavity, the electron gun section, and the magnetic field means. The high frequency oscillating operation of the gyrotron can be thus kept stable and components of the gyrotron cannot be damaged by such vibration. Further, even if the center axis of one section is shifted from that of the other section when the gyrotron apparatus is assembled and installed, this shift can be absorbed by the bellows, thereby preventing mechanical stress-strain from being concentrated on any of the components. This also protects any of the components from being damaged. Furthermore, even when the collector is vibrated and shaken, its vibration cannot be transmitted to the resonant cavity in the oscillation tube unit. The operation of the gyrotron apparatus can be thus kept normal. According to the present invention, therefore, the gyrotron apparatus can be more easily assembled and installed at any desired location. In addition, it can be operated with higher reliability.

Additional objects and advantages of the invention will be set forth in the description which follows, and in part will be obvious from the description, or may be learned by practice of the invention. The objects and advantages of the invention may be realized and obtained by means of the combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the present invention. Like numbered parts are considered the same, and, once discussed, are not again explained.

DETAILED DESCRIPTION OF THE PREFERRED EMBODIMENT

Figure 1:
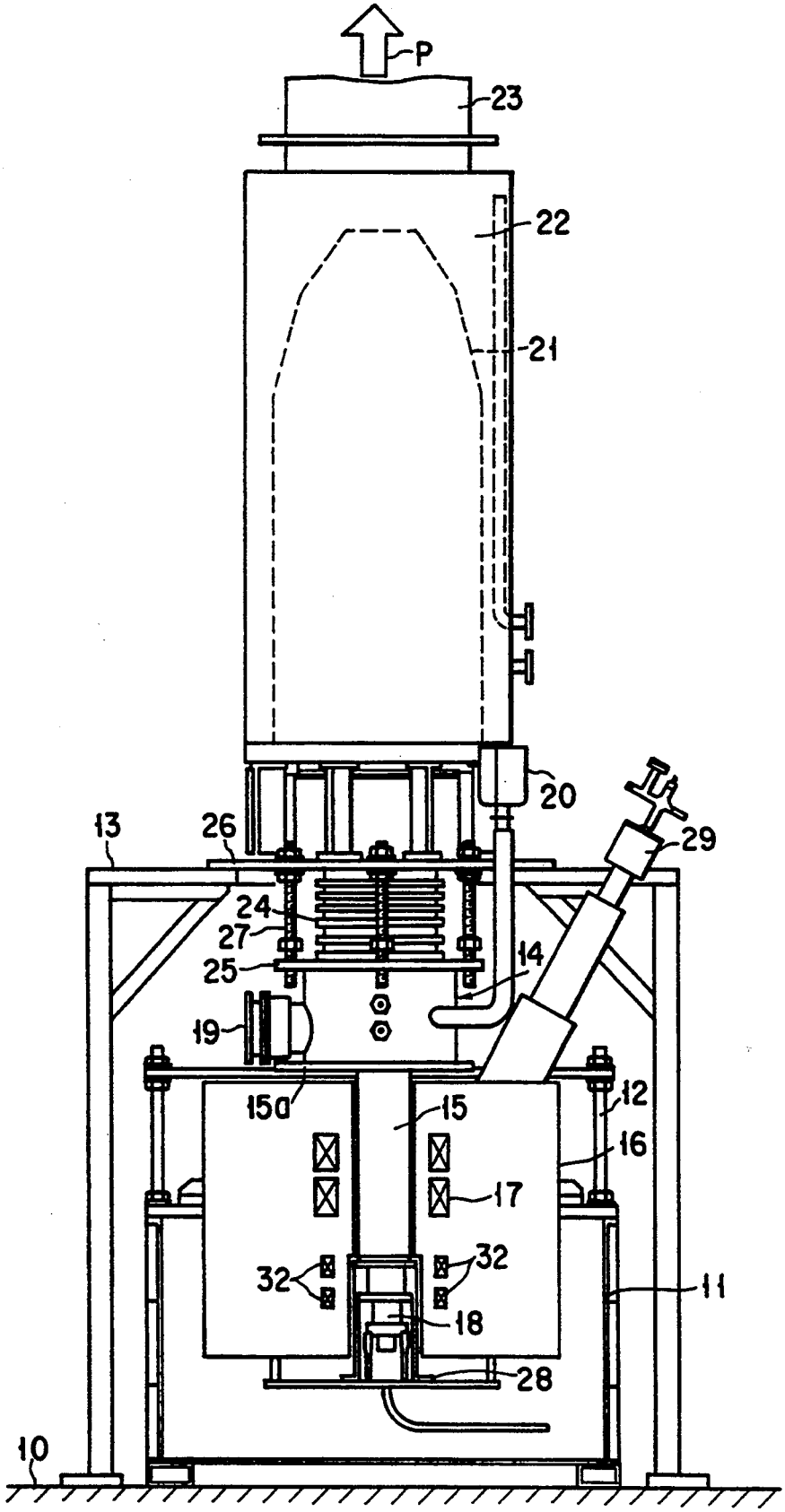
FIG. 1 is a front view schematically showing the gyrotron apparatus according to an embodiment of the present invention.

FIGS. 1 through 4 show the gyrotron apparatus according to an embodiment of the present invention. This gyrotron apparatus has a built-in mode converter is housed in it. As shown in FIG. 1, an oil bus or tank 11 which is filled with insulating oil is arranged on a floor 10 on which the gyrotron apparatus is installed. A superconductive magnet 16 is fixed to the oil bus 11 in such a way that a part of the superconductive magnet 16 is immersed in the oil bus 11. A first support or stand 12 is also fixed to the oil bus 11. However, this first stand 12 may be arranged directly on the floor 10 instead of its being mounted on the top of the oil bus 11. The superconductive magnet 16 includes two sets of electromagnet coils 17 and 32 each set comprising two electromagnet coils 17 or 32. A service port 29 is arranged above the superconductive magnet 16. A second support or stand 13 is arranged on the floor 10 outside the oil bus 11 and the first support 12.

The oscillator tube unit 14 comprises an electron gun section 18 for emitting electron beam, an electromagnetic interaction section 15 having a flange 15*a* in which electric and magnetic fields are applied to the electron beam, an electromagnetic wave output section 19 through which electromagnetic waves generated are delivered, an ion pump 20 for absorbing outgases, and a collector 21 for collecting the electron beam. The electromagnetic interaction section 15 and the collector 21 are connected with an air-tight seal with each other and are in vacuum through a bellows 24. A pair of flanges 25 and 26 are attached to top and bottom of the bellows 24 and plural connecting bolts 27 are attached to the paired flanges 25 and 26, surrounding the bellows 24.

The electron gun, electromagnetic interaction, and output sections 18, 15 and 19 of the oscillator tube unit 14 are mechanically fixed to the first support 12. Also mechanically fixed to the second support 13 are the collector of the oscillator tube unit 14 and an evaporation boiler jacket 22 which encloses the collector 21. A vapor duct 23 is connected to the open top of the boiler jacket 22 to exhaust vapor as shown by an arrow P. A socket 28 is connected to an electrode terminal of the electron gun section 18 in the oil bus 16.

Figure 2:
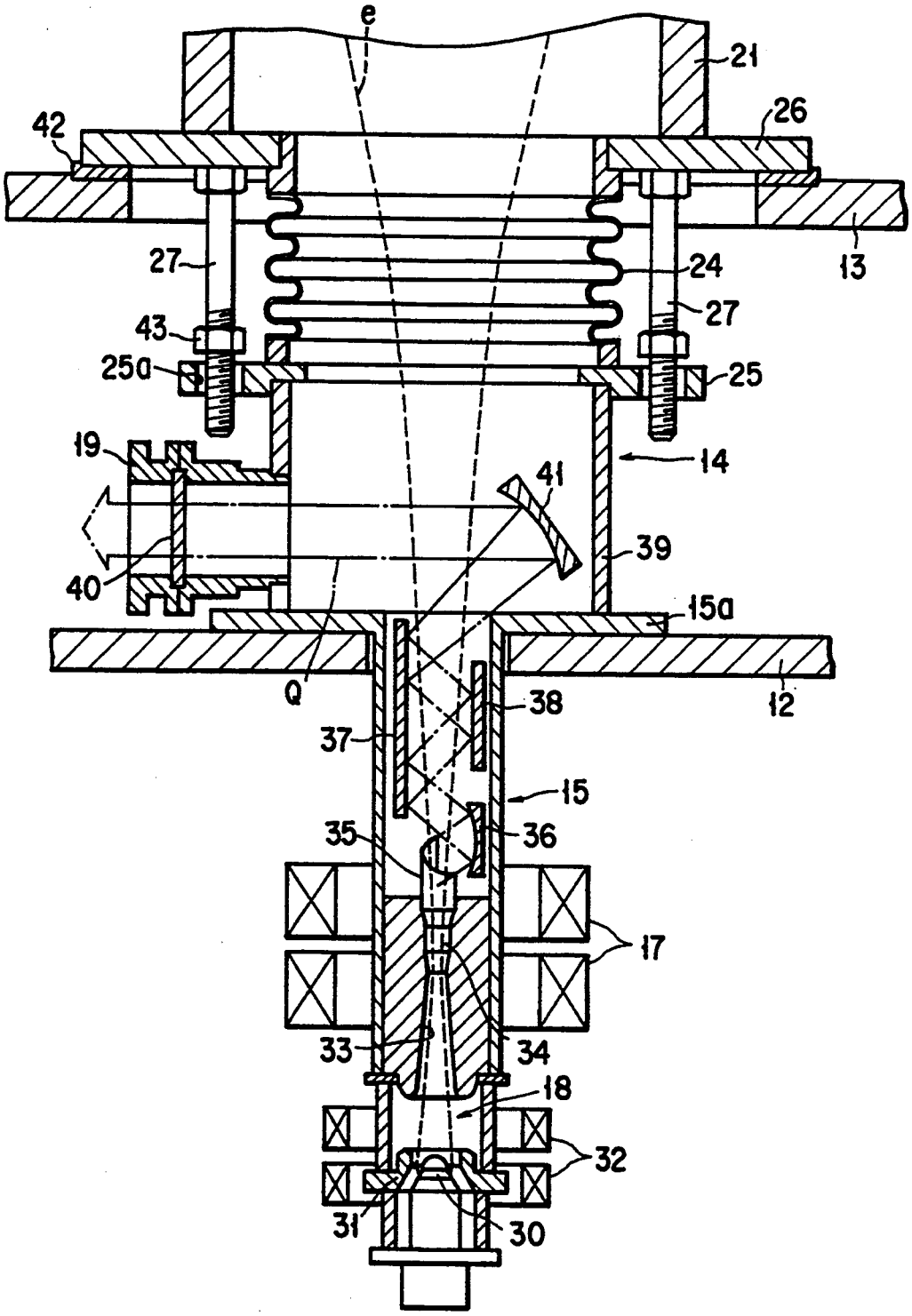
FIG. 2 is a vertically sectioned view showing an oscillation tube unit of the gyrotron apparatus enlarged.

As shown in detail in FIG. 2, the oscillator tube unit 14 includes a modulating anode 31 to accelerate the electron beam around a cathode 30 of the electron gun section 18. The electromagnetic coils 32 are arranged around the electron gun section 18 to shape and gyrate the electron beam. An electron beam introducing section 33 is arranged in front of the cathode 30 and it has a hollow section which decreases in diameter in a direction away from the cathode 31. A resonant cavity 34 is also defined in the electron beam introducing section 33, extending from the tapered hollow portion of the section 33. The electromagnetic coils 17 are arranged round the resonant cavity 34 which is defined in the electron beam introducing section 33 downstream of the electron beam. Thus, a high-frequency electromagnetic field is generated in the resonant cavity 34 and the induced high-frequency electromagnetic field and the electron beam applied are thus caused to interact with one another in the resonant cavity 34. The kinetic energy of the electrons is then transferred to an electromagnetic field. The electromagnetic waves thus generated are mode-converted by a built-in mode converter system which includes a radiator 35, three electromagnetic reflectors 36, 37 and 38, which are shifted from the tube axis. A larger-diameter vacuum envelope 39 is located at a downstream side of the mode converter system and the electromagnetic wave output section 19 which comprises a cylinder wave-guide guide projects from a side of the vacuum container 39. The circular waveguide maintains an air-tight seal on its way by a dielectric window 40. A final stage reflector 41 is arranged in the larger-diameter vacuum container 39. The electromagnetic waves Q generated in the resonant cavity 34 of the electron beam introducing section 33 are directed perpendicularly to the tube axis by the mode converter system as shown by dot- and dash-lines, and transmitted outside, passing through the dielectric window 40. On the other hand, the electron beam (e) advances along the tube axis, spreads passing through the bellows 24, and finally lands on the collector 21.

FIG. 2 shows the coupling bolts 27 and nuts 43, which are arranged around the bellows 24, released free from the bottom flange 25. The coupling bolts 27 are usually released free from the bottom flange 25 in this manner when the gyrotron apparatus is operated. A cushion member 42 is interposed between the flange 26 and the support 13 which are fixed to the collector 21.

Figure 3:
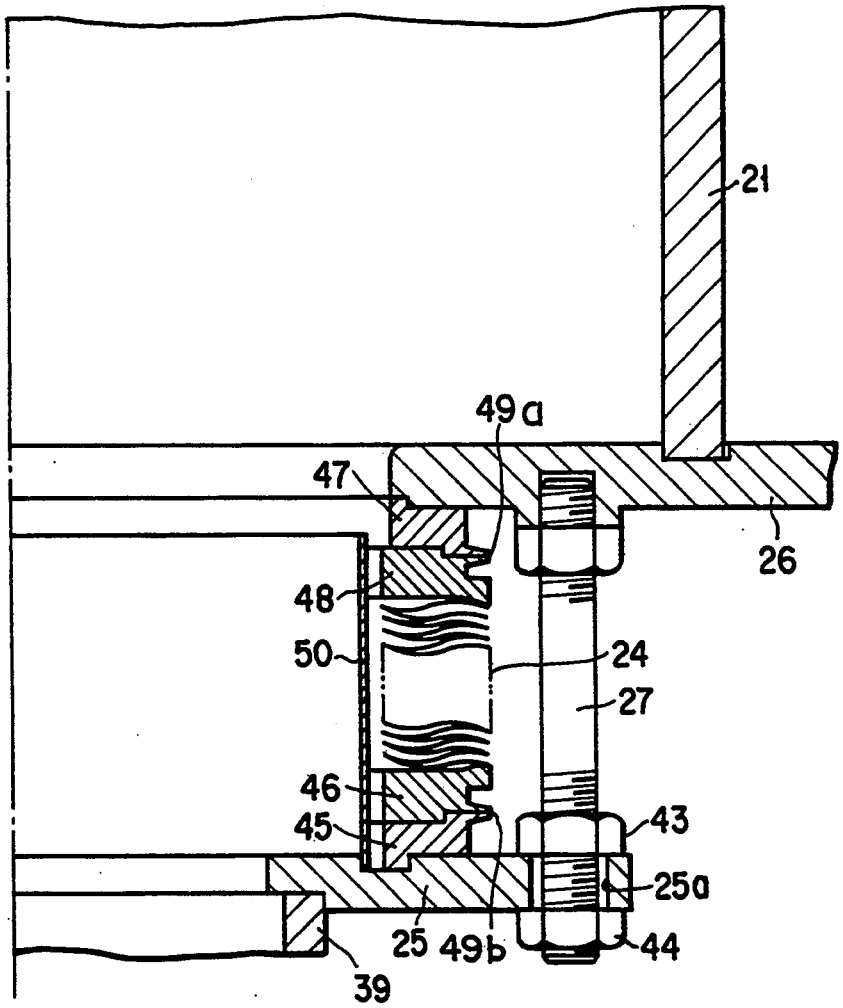
FIG. 3 is a partly sectioned view showing how the gyrotron apparatus is connected at its connecting section before the gyrotron apparatus is installed.

It will be described how the bellows 24 and the coupling bolts 27 function when the gyrotron apparatus is assembled and installed on the floor 10. As shown in FIG. 3, which shows the bellows 24 and its vicinity in detail, the coupling bolts 27 are rigidly fixed to the paired flanges 25 and 26, between which the bellows 24 is sandwiched, by nuts 43 and 44 in the course of assembling, exhausting, and adjusting the gyrotron tube unit as well as in attaching it to the support. More specifically, a seal ring 45 fixed to the bottom flange 25 and another seal ring 46 to which one end of the bellows 24 is connected are sealed at their air-tightly welded portions 49*a*, while a seal ring 47 fixed to the top flange 26 and another seal ring 48 to which the other end of the bellows 24 is connected are sealed at their air-tightly welded portions 49*b*. A sealed cylinder 50 is arranged inside the bellows 24. Each of holes 25*a* of the flange 25 which the coupling bolts 27 penetrates has an inner diameter larger enough than the diameter of the bolts 27 but smaller than the outer diameter of the nuts 43 and washers (not shown) each being interposed between the bottom flange 25 and the nut 43.

The oscillator tube unit 14 including the electron gun section and others, and the collector are connected, as a unit, with each other in the above-described manner. The boiler jacket 22 is fixed water-proof, covering the collector 21, as shown in FIG. 1. The boiler jacket 22 which is under this state is then pulled up by the crane and the electromagnetic interaction section 15 of the oscillator tube unit 14 is inserted into the superconductive magnet 16. A flange 15*a* of the electromagnetic interaction section 15 is mounted on the first support 12 and the top flange 26 for the collector 21 is also mounted on the second support 13 (as seen in FIGS. 1 and 2). It does not necessarily follow that both of the flanges 15*a* and 26 are contacted with both of the supports 12 and 13 at the same time, but one of the flanges which has been contacted first with the support is positioned and fixed relative to the other by bolts (not shown).

Figure 4:
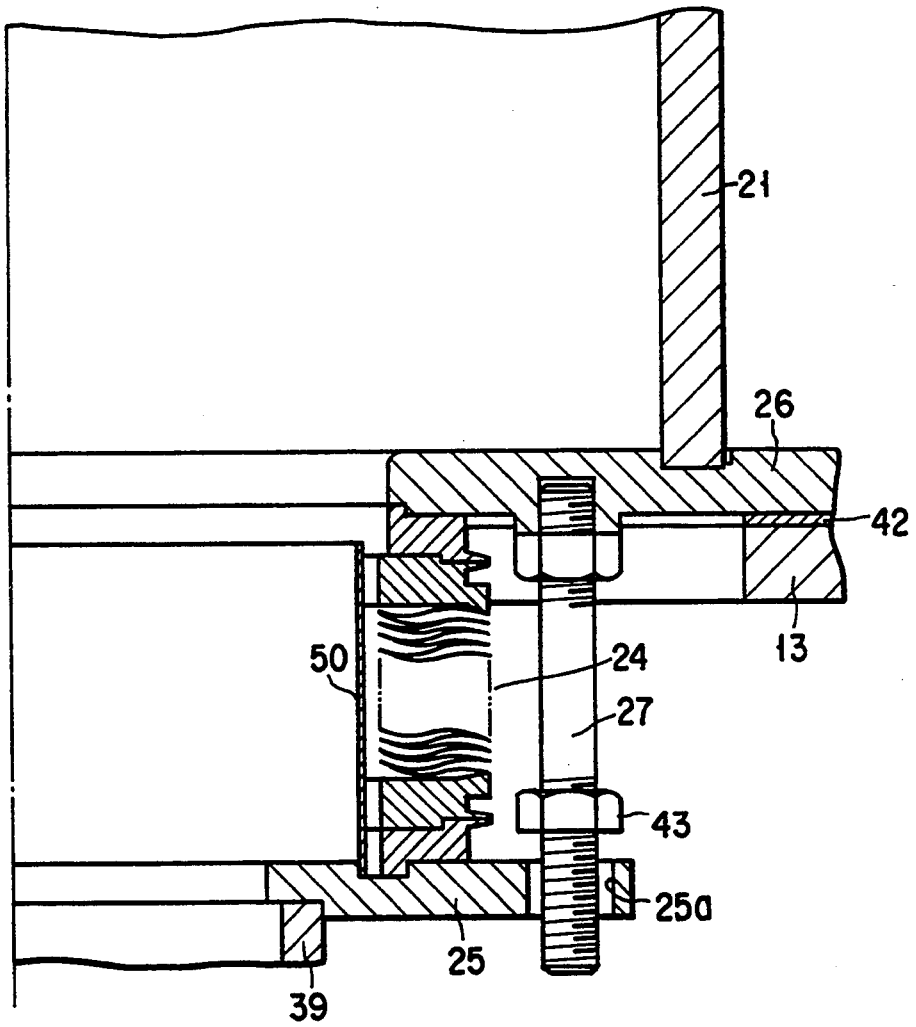
FIG. 4 is a partly sectioned view showing how the gyrotron apparatus is connected at its connecting section after it is installed.

The nuts 43 and 44 which have bound the coupling bolts 27 around the bellows 24 are then unbound and both of the flanges 25 and 26 are released free from each other, as shown in FIG. 4. Each of the holes 25*a* through which the bolts are bound by nuts 43 and 44 has such inner diameter that is larger enough than the outer diameter of each of the bolts 27. When the nuts 43 and 44 are loosened, the bolts 27 are released free from the flange 25. Both of the flanges 25 and 26 are released free from each other in this manner and the other of the flanges 15*a* and 26 is contacted with its corresponding support and positioned and fixed to it. The positional shift of one of the flanges 15*a* and 26 relative to the other is absorbed by the flexibility of bellows 24, as can be appreciated from FIG. 4. The oscillator tube unit 14 from the electron gun section 18 to the output section 19 is thus mechanically fixed to and held by the support 12, the collector 21 and the jacket 22 are also mechanically fixed to and held by the other support 13. Even if the collector structure is vibrated and shaken, therefore, these vibrations of the collector structure are hardly propagated to the electromagnetic interaction section. If the gyrotron apparatus moved or if the jacket is dismantled, both of the flanges 25 and 26 are rigidly connected and fixed to each other by bolts 27 and nuts Thereafter, the gyrotron apparatus is moved or the jacket is dismantled using a crane.

A variation of the gyrotron apparatus according to the present invention will be described referring to FIG. 5. In the case of the gyrotron apparatus shown FIG. 5, the collector structure 21 is mechanically fixed to and held by the support 13 through the coolant guide member or vapor duct 23. More specifically, the vacuum container 39 including the electromagnetic waves output section of the oscillator tube unit 14 is connected in an air-tight seal to the collector 21 by the first bellows 24, as seen in the above-described example. The second vacuum bellows 51 is further arranged between the boiler jacket 22 and the coolant guide member or vapor duct 23. The second bellows 51 is air-tightly sandwiched between a front flange 22*a* of the boiler jacket 22 and a flange 23*a* of the coolant guide member or vapor duct 23 which are supported by plural bolts 52 around it. When assembling and installing of the gyrotron apparatus are finished, the bolts 27 around the first bellows 24 are released free from the flange 25, causing the flange 26 to be released free from the flange 25, but the bolts 52 around the second bellows 51 are bound to both of the flanges 22*a* and 23*a* rigidly and mechanically fixed to them by nuts 53, 54 and 55. The electromagnetic interaction section of the oscillation tube unit 14 is thus fixed to and supported by the support 12, while the collector 21 and boiler jacket 22 are mechanically fixed to and held by the support 13 via the plural bolts and nuts, by which the flanges on both ends of the second bellows 51 are connected to each other, and also via the vapor duct 23. Therefore, the first bellows 24 serves to absorb collector vibrations so the vibrations are not transmitted to the electromagnetic interaction section. The flanges on both ends of the second bellows 51 serve to mechanically hold the collector electrode section while being bound by the plural bolts and nuts.

Figure 5:
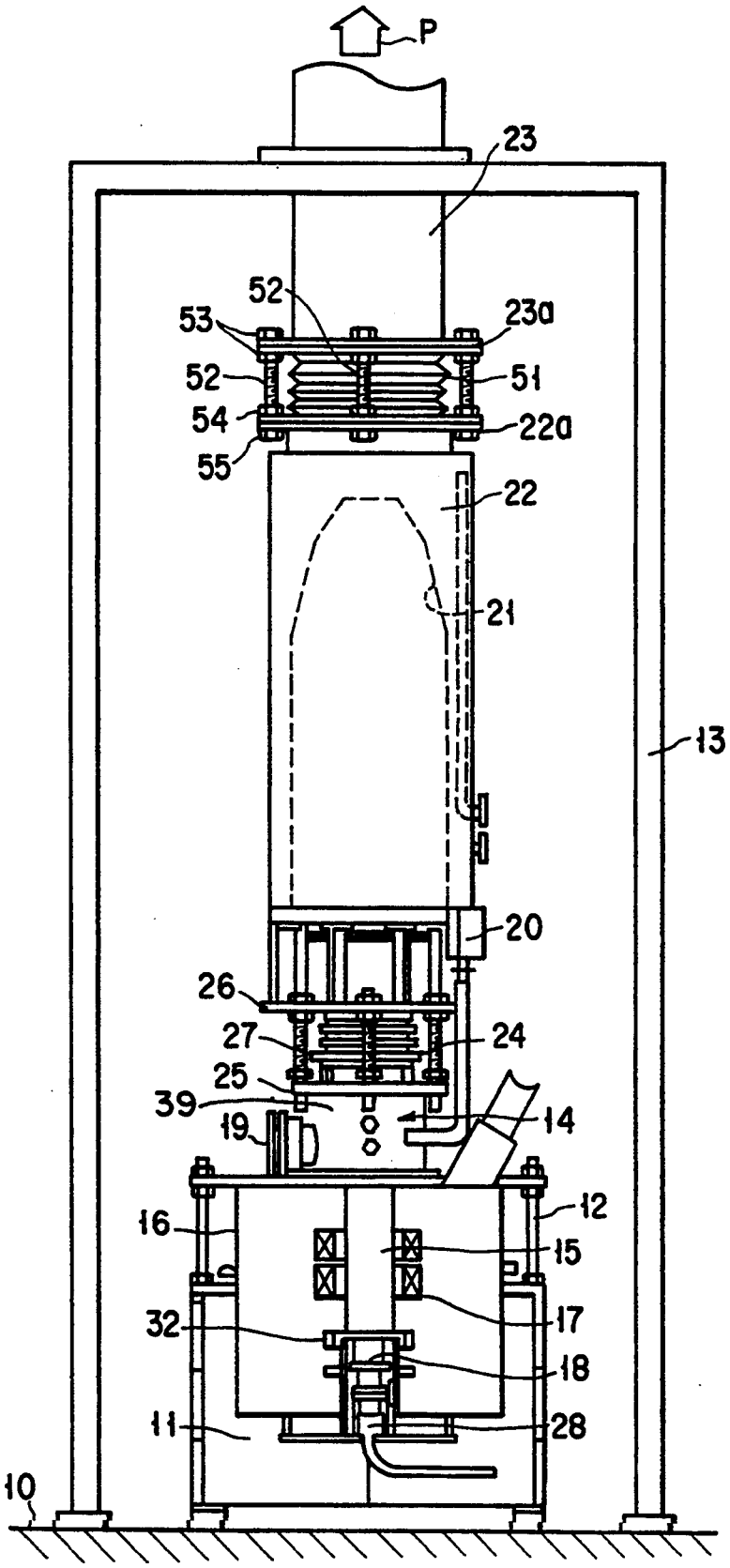
FIG. 5 is a front view schematically showing the gyrotron apparatus according to another embodiment of the present invention.
Figure 6:
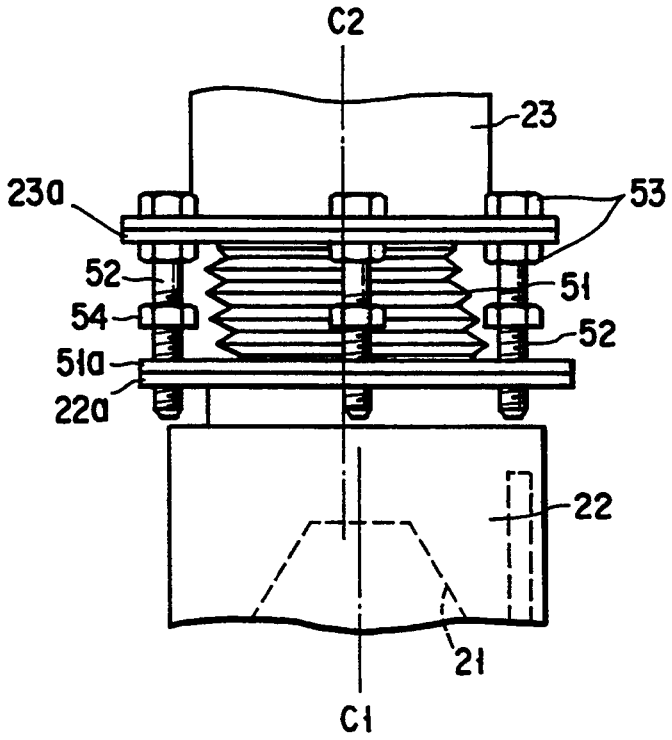
FIG. 6 is a part view showing how the gyrotron apparatus in FIG. 5 is connected at its connecting section before it is installed.
Figure 7:
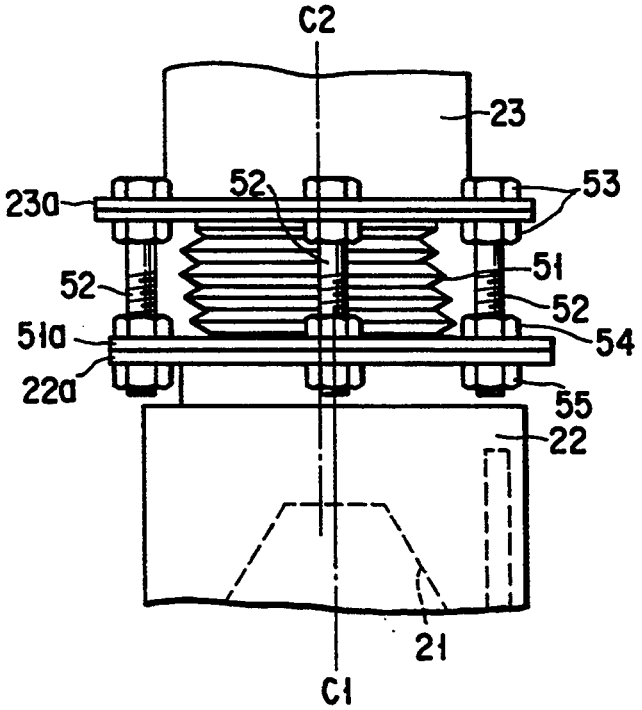
FIG. 7 is a part view showing how the gyrotron apparatus in FIG. 5 is connected at its connecting section after it is installed.

Referring to FIGS. 6 and 7, it will be described how the selectively attached bellows functions when the gyrotron apparatus is to be assembled and installed. As already described in the above case, both of the flanges 25 and 26 which sandwich the first vacuum bellows 24 between them are rigidly connected to each other by the plural bolts 27 and the nuts. When the flanges 25 and 26 are under this state, the boiler jacket 27 is pulled up by the crane and the oscillator tube unit 14 is fixed to the support 12. As shown in FIG. 6, the vapor duct 23 which has been fixed to the support 13 (shown in FIG. 5) and a flange 51*a* of the second bellows 51 which is located under the vapor duct 23 are then aligned with the top flange 22*a* of the boiler jacket 22. FIG. 6 shows the center axis C1 of the collector 21 and the boiler jacket 22 of the oscillation tube unit 14 shifted from axis C2 of the vapor duct 23 which has been fixed to the support 13 (shown in FIG. 5). This positional shift can be absorbed by the flexibility of second bellows 51. For this purpose, the top flange 22*a* of the boiler jacket 22 and the bottom flange 51*a* of the bellows 51 are provided with holes through which the bolts 52 are passed. The plural bolts 52 are passed through the holes of the flanges. The nuts 54 and 55 are fitted onto the bolts 52 and bound to rigidly fix both of the flanges 51*a* and 22*a*, as shown in FIG. 7, leaving the center axes C1 and C2 shifted from each other. Finally, the nuts 43 by which the bottom flange 25 of the first bellows 24 has been fixed are loosened, as shown in FIG. 4.

The electromagnetic interaction section of the oscillation tube unit 14 which is located under the first bellows 24 is thus fixed to and held by the support 12, while the collector 21 and the boiler jacket 22 are fixed to and held by the other support 13 through the vapor duct 23, as seen in FIG. 5. The positional shift caused when the gyrotron apparatus is assembled and installed can be therefore absorbed by the second bellows 51. Even if the collector and the boiler jacket are vibrated and shaken when the gyrotron apparatus is in operation, it can be absorbed by the first bellows so they are not transmitted to the electromagnetic interaction section and the superconducting magnet. Even when the gyrotron apparatus is being assembled, installed or operated, no mechanical stress-strain is added to any of the components, thereby preventing them from being broken or damaged.

The present invention is not limited to the gyrotron apparatus of the evaporation cooling type but it can be applied to those of the water cooling and forced air cooling types.

According to the present invention as described above, the positional shift of components caused when the gyrotron apparatus is assembled and installed on the floor, and the vibration of the collector and the boiler jacket caused when the apparatus is in operation can be absorbed by the bellows. No mechanical stress-strain can be therefore concentrated on any of components, thereby preventing them from being mechanically broken. The gyrotron apparatus can be thus used while keeping its operation more stable and normal. In addition, it can be more easily assembled and installed at any place intended.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A gyrotron apparatus comprising:

a gyrotron oscillator tube unit including:

means for generating a gyrating electron beam which has a direction of advance;

means for collecting said gyrating electron beam;

a resonant cavity, located between said electron beam generating means and said electron beam collecting means, into which said electron beam is introduced from said electron beam generating means; and means, surrounding said electron beam generating means, for applying a magnetic field to said electron beam to thereby cause said electron beam to interact with said magnetic field in said resonant cavity to generate high energy electromagnetic waves;

means, surrounding said electron beam collecting means, for cooling said electron beam collecting means;

first support means for supporting said electron beam generating means, said resonant cavity, and said magnetic field applying means;

second support means for supporting said electron beam collecting means and said cooling means;

means for air-tightly coupling said electron beam collecting means to said resonant cavity at first and second ends of said coupling means, respectively, said coupling means including a deformable bellows portion for absorbing vibration produced in the operation of said electron beam collecting means; and means for positionally fixing said electron beam collecting means to said resonant cavity in relation to one another when said gyrotron apparatus is transported.

2. The gyrotron apparatus according to claim 1, wherein said means for cooling the collector means is an evaporation cooling jacket.

3. The gyrotron apparatus according to claim 1, wherein said coupling means further includes a flange attached to said resonant cavity and a flange attached to said collecting means, said flanges being connected to said first and second ends of said coupling means, respectively, said flanges having releasable coupling members attached thereto.

4. The gyrotron apparatus according to claim 1, further comprising:

direction changing means arranged in a vacuum region between said resonant cavity and said bellows portion to redirect the electromagnetic waves perpendicularly to the direction in which the electron beam advances; and an output section for introducing the electromagnetic waves, whose direction has been changed, outside the gyrotron apparatus.

5. A gyrotron apparatus comprising:

a gyrotron oscillator tube unit including:

means for generating gyrating electron beams which have a direction of advance;

means for collecting said electron beams;

a resonant cavity, located between said generating means and said collecting means, into which said generated electron beams are introduced and in which a high frequency electromagnetic field is produced; and means, surrounding said electron beam generating means, for applying a magnetic field to the electron beams and causing the electron beams to interact with the high frequency electromagnetic field in the resonant cavity to generate electromagnetic waves;

a first support for supporting said resonant cavity;

a boiler jacket for cooling said collecting means of said oscillator tube unit, said boiler jacket surrounding said collecting means;

a guide member;

a second support for supporting said collecting means, the boiler jacket and the guide member;

a first deformable bellows portion for air-tightly coupling said resonant cavity to said electron beam collecting means at first and second ends said second deformable bellows portion having has been changed to; and a second deformable bellows portion for coupling said boiler jacket to said guide member at first and second ends of said second deformable bellows portion, respectively.

6. The gyrotron apparatus according to claim 5, further comprising:

direction changing means arranged in a vacuum region between said resonant cavity and said first deformable bellows portion to redirect the electromagnetic waves perpendicular to the direction in which the electron beam advances; and an output section for introducing the electromagnetic waves, whose direction has been changed, outside the gyrotron apparatus.

7. The gyrotron apparatus according to claim 5, further comprising a first flange attached to said resonant cavity and a second flange attached to said collecting means, said first and second flanges being fixed to respective said first and second ends of said first deformable bellows portion.

* * * * *